US005985803A

United States Patent [19]

Rizvi et al.

[11] Patent Number: 5,985,803

[45] Date of Patent: Nov. 16, 1999

[54] POLYETHOXYLATED ALCOHOL-BASED PHOSPHONATES FOR METAL WORKING LUBRICANTS

[75] Inventors: Syed Q. A. Rizvi, Painesville; Carmen V. Luciani, Wickliffe, both of Ohio

[73] Assignee: The Lubrizol Corporation, Wickliffe, Ohio

[21] Appl. No.: 08/985,450

[22] Filed: Dec. 5, 1997

[51] Int. Cl.[6] ..... C10M 137/12; C10M 155/04

[52] U.S. Cl. ..... 508/194; 508/429; 508/430

[58] Field of Search ..... 508/194, 430, 508/429; 558/180; 72/42

[56] References Cited

U.S. PATENT DOCUMENTS

| | | | |
|---|---|---|---|
| 2,568,472 | 9/1951 | Trautman | 508/194 |
| 2,999,064 | 9/1961 | Sluhan | 508/194 |
| 3,359,203 | 12/1967 | O'Halloran et al. | 252/46.6 |
| 3,600,470 | 8/1971 | Lewis | 260/924 |
| 3,763,287 | 10/1973 | Chiddix et al. | 260/941 |
| 4,178,260 | 12/1979 | Cook . | |
| 4,256,594 | 3/1981 | Rysek | 252/49.9 |
| 4,303,540 | 12/1981 | Schuster | 508/194 |
| 4,342,658 | 8/1982 | Tincher et al. | 252/32.5 |
| 4,533,481 | 8/1985 | Jannke | 508/194 |
| 4,650,595 | 3/1987 | Nagamorie et al. | 508/194 |
| 4,664,823 | 5/1987 | Kuwasmoto et al. | 508/194 |
| 4,741,848 | 5/1988 | Koch et al. | 508/194 |
| 5,059,335 | 10/1991 | Rizvi et al. | 252/32.5 |
| 5,282,989 | 2/1994 | Erickson et al. | 508/430 |
| 5,302,305 | 4/1994 | Jolley et al. | 508/430 |
| 5,543,081 | 8/1996 | Ishida et al. | 508/190 |

*Primary Examiner*—Margaret Medley
*Attorney, Agent, or Firm*—James L. Cordek; Joseph P. Fischer

[57] ABSTRACT

Disclosed is a metal working composition comprising a major amount of water and a minor amount of an additive comprising (A) at least one carboxylic ester characterized by the formula

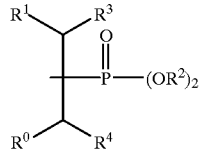

wherein $R^0$ is hydrogen, methyl, ethyl, —$CH_2COOR^2$ or —$CH_2CO(OCHR^5CH_2)_nOR^6$, $R^1$ is hydrogen, methyl or ethyl, $R^2$ is an alkyl group containing from 1 to 12 carbon atoms, $R^3$ is hydrogen or —$CO(OCHR^5CH_2)_nOR^6$, $R^5$ is hydrogen or a methyl group, $R^6$ is an aliphatic group containing from 4 to 30 carbon atoms or a phenyl or aliphatic substituted phenyl group wherein the aliphatic substituent contains from 1 to 8 carbon atoms, $R^4$ is —$COOR^2$, or —$CO(OCHR^5CH_2)_nOR^6$ and n is an integer of from 1 to 30; with the proviso that when $R^0$ does not equal hydrogen, methyl or ethyl that $R^1$ and $R^3$ are hydrogen and (B) at least one rust inhibitor comprising (1) an amine acid salt or amide;

(2) a nitrogen-containing, phosphorus-free carboxylic composition;

(3) an amine; or (4) an alkoxylated amine.

47 Claims, No Drawings

POLYETHOXYLATED ALCOHOL-BASED PHOSPHONATES FOR METAL WORKING LUBRICANTS

FIELD OF THE INVENTION

This invention relates to metal working operations. More particularly, it relates to polyethoxylated alcohol-based phosphonates useful as lubricants for lubricating metal during such operations and to metal workpieces so lubricated.

BACKGROUND OF THE INVENTION

Metal working operations, for example, drawing, hot pressing, blanking, bending, stamping, rolling, forging, cutting, punching, spinning, and the like generally employ a lubricant to facilitate the same. Lubricants greatly improve these operations in that they can reduce the power for the operation, prevent sticking and decrease wear of dies, cutting bits and the like. In addition, they frequently provide rust inhibiting properties to the metal being treated.

Many of the lubricants applied for the above purposes are liquids. The equipment used for the application of such liquids is often expensive to maintain and inconvenient to use. In addition, a dry-off oven is usually required to remove the water or solvent carrier from the liquid composition, which also greatly adds to the capital costs and operating and maintenance expenses of the method. Difficulties are often encountered in automatic feeding of metal blanks and otherwise handling the metal because the liquid compositions which are normally applied to the metal make it wet and slippery and consequently difficult to handle.

U.S. Pat. No. 3,359,203 (O'Halloran, Dec. 19, 1967) relates to the use of an oil-soluble reaction product of a dihydrocarbon dithiophosphoric acid and a lower alkyl alcohol ester of maleic acid or of fumaric acid as an ashless additive for imparting anti-wear properties and anti-corrosion properties to lubricant compositions.

U.S. Pat. No. 3,600,470 (Lewis, Aug. 17, 1971) relates to hydroxy substituted phosphonates that are produced by reacting a halohydrin with an aliphatic or aromatic phosphite. At high temperatures, an acidic compound is formed instead of, or at least substantially in place of the neutral compound. The neutral ester of the phosphonic acid can be subjected to either acidic or basic hydrolysis to form the free phosphonic acid, which in turn can react with alkyl amines or alkylol amines to form excellent corrosion inhibitors. The neutral esters themselves can be used as additives for extreme pressure lubricants.

U.S. Pat. No. 3,763,287 (Chiddix et al., Oct. 2, 1973) is directed to phosphorus containing compounds which are particularly useful as antioxidant agents for stabilization of organic compounds which tend to deteriorate in storage or in use due to oxidation or other such reactions. More particularly the reference is directed to phosphites, phosphates, phosphonates, thiophosphates and thiophosphonates derived from ω-(3,5-dialkyl-4-hydroxyphenyl) alkanols.

U.S. Pat. No. 4,256,594 (Rysek, Mar. 17, 1981) is concerned with metal working operations, especially drawing, that are facilitated by applying to the metal a composition which provides lubricity thereto, which melts between about 30° C. and about 150° C., and which contains a minor amount of a phosphorus-containing composition which may be prepared by the reaction of an alkoxylated alkyl phenol with a phosphorus trihalide, or, in combination with water, with a triaryl phosphite. The former reaction also produces, as a by-product, the corresponding halide. The phosphorus-containing compositions are especially useful in combination with a chlorinated wax. The preferred lubricant bases for the metal working lubricants comprise esters or polymers of epoxides or episulfides.

U.S. Pat. No. 4,342,658 (Tincher et al., Aug. 3, 1982) relates to a water-based hydraulic fluid or metal working composition which can be obtained by blending water in a major proportion with minor effective lubricating amounts of a mixture of a phosphate ester, a polyethylene ester, a polyester of an oxyalkylene compound, and an alkyl dialkanolamide.

The metal working fluids and hydraulic fluids of this reference contain a minor effective amount of a phosphate ester salt selected from the group consisting of

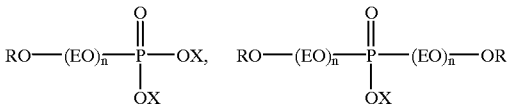

and mixtures thereof wherein EO is ethylene oxide; R is a monovalent alkylaryl group wherein the alkyl group thereof has about 4 to about 20 carbon atoms, X is individually selected from the group consisting of an alkali metal, an alkaline earth metal, the residue of ammonia, the residue of an amine, and mixtures thereof; n is generally a number from 1 to 50, and preferably 2 to 10.

U.S. Pat. No. 4,533,481 (Jahnke, Aug. 6, 1985) relates to corrosion inhibitors which prevent corrosion of metal surfaces contacted by aqueous compositions containing them. More particularly the reference relates to corrosion inhibitors which are amine salts of mixtures of polycarboxylic acids and boric acid. The reference also relates to aqueous systems containing the aforedescribed corrosion inhibitors and methods of inhibiting corrosion of metal which comprises contacting metal with said aqueous systems.

U.S. Pat. No. 5,059,335 (Rizvi et al., Oct. 22, 1991) relates to lubricating compositions containing hydroxyalkane phosphonic acids and derivatives thereof. Hydroxyalkane phosphonic acids in this reference can be reacted to form salts with basic materials, including detergents, dispersants and amines. These materials can be particularly useful in lubricating compositions to improve anti-wear and extreme pressure properties of lubricating formulations. The hydroxyalkane phosphonic acid is represented by the following formula:

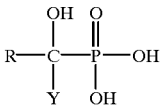

wherein Y is a phosphonic acid group or hydrogen, and R is alkyl from 1 to about 100 carbon atoms.

U.S. Pat. No. 5,302,305 (Jolley et al., Apr. 12, 1994) relates to carboxylic esters and more particularly to phosphorus-containing carboxylic esters and their use as synthetic lubricants and as lubricants in liquid compositions containing liquid fluorine-containing hydrocarbons. More particularly, the reference relates to synthetic lubricants and to liquid compositions useful as refrigeration liquids.

SUMMARY OF THE INVENTION

A metal working composition is disclosed which comprises a major amount of water and a minor amount of an additive comprising (A) at least one carboxylic ester characterized by the formula

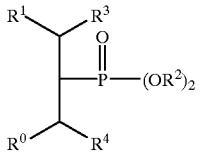

wherein $R^0$ is hydrogen, methyl, ethyl, —$CH_2COOR^2$ or —$CH_2CO(OCHR^5\ CH_2)_nOR^6$, $R^1$ is hydrogen, methyl or ethyl, $R^2$ is an alkyl group containing from 1 to 12 carbon atoms, $R^3$ is hydrogen or —$CO(OCHR^5CH_2)_nOR^6$, $R^5$ is hydrogen or a methyl group, $R^6$ is an aliphatic group containing from 4 to 30 carbon atoms or a phenyl or aliphatic substituted phenyl group wherein the aliphatic substituent contains from 1 to 8 carbon atoms, $R^4$ is —$COOR^2$ or —$CO(OCHR^5CH_2)_nOR^6$, and n is an integer of from 1 to 30; with the proviso that when $R^0$ does not equal hydrogen, methyl or ethyl that $R^1$ and $R^3$ are hydrogen and (B) at least one rust inhibitor comprising (1) an amine acid salt or amide derived from (a) at least one acid comprising a carboxylic acid corresponding to the formula $$R^7(COOH)_{1\text{-}3}$$

wherein $R^7$ is an alkyl, alkylene, alkenylene, alkynylene, hydroxy alkyl or hydroxy alkylene group containing from 4 to 25 carbon atoms, and optionally (b boric acid, with (c) at least one monoamine corresponding to the formula $$(R^8)_3N$$

wherein each $R^8$ is independently hydrogen, a $C_{1\text{-}21}$ hydrocarbyl or a $C_{2\text{-}21}$ hydroxy hydrocarbyl group;

(2) a nitrogen-containing, phosphorus-free carboxylic composition made by the reaction of (a) at least one polycarboxylic acid acylating agent having at least one hydrocarbon based substituent of 12 to 500 carbon atoms with (b) at least one (i) N-(hydroxyl-substituted hydrocarbyl) amine, (ii) hydroxy-substituted poly (hydrocarbyloxy) analog of said amine or (iii) mixtures of (i) and (ii);

(3) an amine of the formula

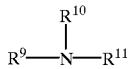

wherein each of $R^9$, $R^{10}$ and $R^{11}$ is individually selected from the group consisting of hydrogen atoms, hydrocarbyl radicals containing from 1 to 40 carbon atoms and hydroxy-substituted hydrocarbyl radicals containing from 1 to 40 carbon atoms provided that at least one of $R^9$, $R^{10}$ and $R^{11}$ is said hydrocarbyl or hydroxy-substituted hydrocarbyl radical; or (4) an alkoxylated amine of the formula

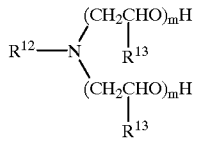

wherein $R^{12}$ is an aliphatic group containing from 8 to 28 carbon atoms, $R^{13}$ is independently hydrogen or methyl and m is an integer independently from 1 to 10.

DETAILED DESCRIPTION OF THE INVENTION

Throughout this specification and claims, all parts and percentages are by weight, temperatures are in degrees Celsius, and pressures are at or near atmospheric unless otherwise clearly indicated.

As used in this specification and in the appended claims, the terms "hydrocarbyl" and "hydrocarbylene" denote a group having a carbon atom directly attached to the polar group and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), and the like, as well as cyclic groups wherein the ring is completed through another portion of the molecule (that is, any two indicated substituents may together form a ring). Such groups are known to those skilled in the art. Examples include methyl, ethyl, octyl, decyl, octadecyl, cyclohexyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, alkoxy, etc.

(3) Hetero groups, that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl", "alkylene", etc. have meanings analogous to the above with respect to hydrocarbyl and hydrocarbylene.

The term "hydrocarbon-based" also has the same meaning and can be used interchangeably with the term hydrocarbyl when referring to molecular groups having a carbon atom attached directly to the polar group.

The term "lower" as used herein in conjunction with terms such as hydrocarbyl, alkyl, alkenyl, alkoxy, and the like, is intended to describe such groups which contain a total of up to 7 carbon atoms.

(A) The Carboxylic Ester

As Component (A) of this invention, the carboxylic ester is characterized by the formula

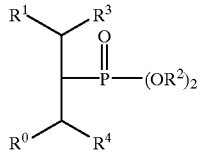

wherein $R^0$ is hydrogen, methyl, ethyl, —$CH_2COOR^2$ or —$CH_2CO(OCHR^5CH_2)_nOR^6$, $R^1$ is hydrogen, methyl or ethyl, $R^2$ is an alkyl group containing from 1 to 12 carbon atoms, $R^3$ is hydrogen or —$CO(CHR^5CH_2)_nOR^6$, $R^5$ is hydrogen or a methyl group, $R^6$ is an aliphatic group containing from 4 to 30 carbon atoms or a phenyl or aliphatic substituted phenyl group wherein the aliphatic substituent contains from 1 to 8 carbon atoms, $R^4$ is —$COOR^2$ or —$CO(CHR^5CH_2)_nOR^6$ and n is an integer of from 1 to 30; with the proviso that when $R^0$ does not equal hydrogen, methyl or ethyl that $R^1$ and $R^3$ are hydrogen.

The carboxylic ester is prepared by reacting an alkoxylated alcohol or phenol with an acid source to form an intermediate. The alkoxylated alcohol or phenol is of the formula

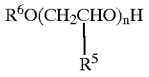

wherein $R^6$ is an aliphatic group containing from 4 to 30 carbon atoms or a phenyl or aliphatic substituted phenyl group wherein the aliphatic substituent contains from 1 to 8 carbon atoms, $R^5$ is hydrogen or methyl and n is an integer of from 1 to 30. Preferably $R^6$ is an aliphatic group that contains from 8 to 18 carbon atoms. The most preferred $R^6$ is an alkyl group containing from 12 to 18 carbon atoms.

The alkoxylated alcohol or phenol is prepared by reacting an alcohol or phenol with an alkylene oxide $$R^6OH + nAO \rightarrow R^6O(AO)_nH$$

wherein n represents the number of moles of alkylene oxide AO that reacts with one mole of alcohol or phenol $R^6OH$. The alkylene oxides employed are ethylene oxide and propylene oxide wherein $R^5$ is hydrogen and methyl, respectively. Preferably $R^5$ is hydrogen. Especially preferred ethoxylated alcohols are available from Union Carbide as Tergitol 15-S-3, 15-S-5, 15-S-7 and 15-S-12 wherein "15" represents the approximate number of carbon atoms, "S" represents the fact that the alcohol is a secondary alcohol and the number following the "S" represents the value of n.

The acid source that is reacted with the alkoxylated alcohol or phenol to form the intermediate comprises a monocarboxylic acid, dicarboxylic acid or anhydride. When an acid is employed, it must be an α,β-unsaturated acid. The monocarboxylic acids that are α,β-unsaturated acids are acrylic acid, methacrylic acid, cis-2-butenoic acid, trans-2-butenoic and cinnamic acid. The dicarboxylic acids that are α,β-unsaturated acids are of the formulae

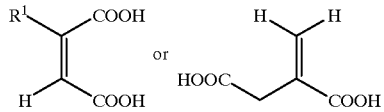

wherein $R^1$ is hydrogen, methyl or ethyl. Any cis or trans isomerism is also incorporated by the above structures. That is, a generic formula

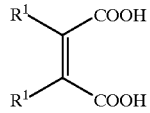

wherein $R^1$ is hydrogen includes both cis-butenedioic acid (maleic acid) and trans-butenedioic acid (fumaric acid) of the respective formulae

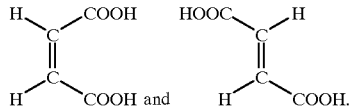

The α,β-unsaturated dicarboxylic acids that satisfy the above formulae are maleic acid, fumaric acid, methylmaleic acid, ethylmaleic acid and itaconic acid. Preferred is maleic acid.

Anhydrides which have cyclic unsaturation and are of the formula

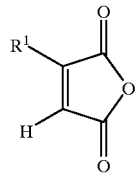

also have utility as an acid source. In the anhydride formula, $R^1$ is hydrogen, methyl or ethyl. Anhydrides of the above formula having utility in this invention are maleic anhydride, methylmaleic anhydride and ethylmaleic anhydride. Preferred is maleic anhydride.

Reacting the alkoxylated alcohol or phenol with the acid source forms the intermediate. The carboxylic ester (A) is formed when a phosphite ester is reacted with the intermediate. When the alkoxylated alcohol or phenol is reacted with a monocarboxylic acid as the acid source, the reaction that gives intermediate a is as follows:

a

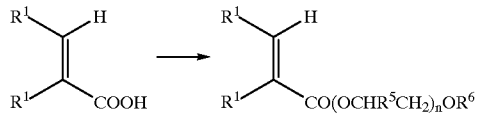

When the acid source is an anhydride, the reaction scheme is b

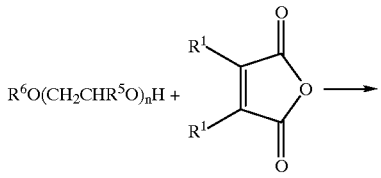

-continued

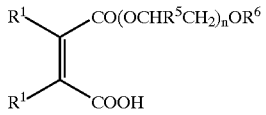

or

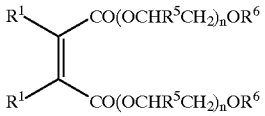

c

The intermediate obtained is dependent upon the mole ratio of alkoxylated alcohol or phenol to anhydride. When the mole ratio is 1:1, intermediate b is formed. When the mole ratio of alkoxylated alcohol or phenol to anhydride is greater than 2:1, intermediate c is formed. Reacting the alkoxylated alcohol or phenol with the dicarboxylic acids of the formula

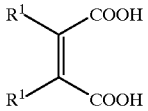

give the identical intermediates of b and c as obtained when an anhydride is employed.

Reacting the alkoxylated alcohol or phenol at the two different mole ratios with itaconic acid gives the following intermediates:

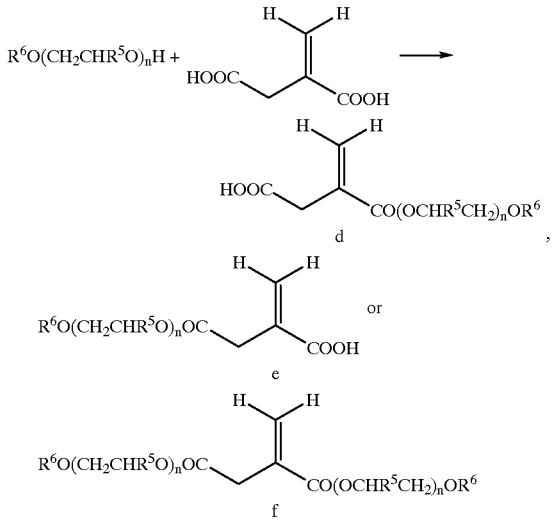

Once the intermediate is formed, it is reacted with a phosphite to complete the formation of the carboxylic ester (A). If the intermediate has a free (unreacted) carboxyl group, as in intermediates b, d and e, the phosphite is of the formula $(R^2O)_3P$. If the intermediate has no free carboxyl groups, that is, is completely esterified as in intermediates a, c and f, the phosphite is of the formula $(R^2O)_2PHO$.

It is not known with absolute certainty which carbon of the carbon—carbon double bond that the phosphorus of the phosphite will attack. The reaction of methacrylic acid and an alkoxylated alcohol or phenol produces the following intermediate:

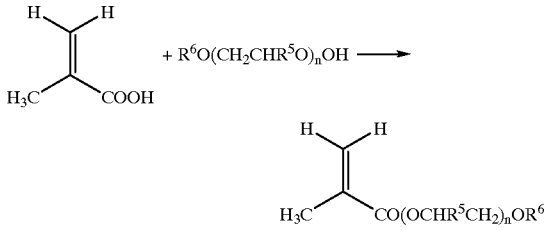

Two different phosphite addition products as the carboxylic ester (A) of the above intermediate are envisioned. They are

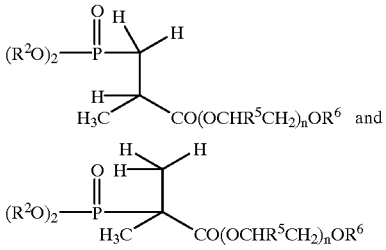

Not wishing to be bound by theory, the inventors choose to write the above products generally as

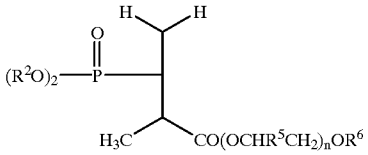

It is understood that hydrogen will add to the carbon of the carbon—carbon double bond opposite to the carbon of the carbon—carbon double bond to which the phosphorus adds.

The following equations depict the formation of the carboxylic ester (A) by the reaction of the phosphite $(R^2O)_3P$ with the various intermediates containing a free carboxylic group:

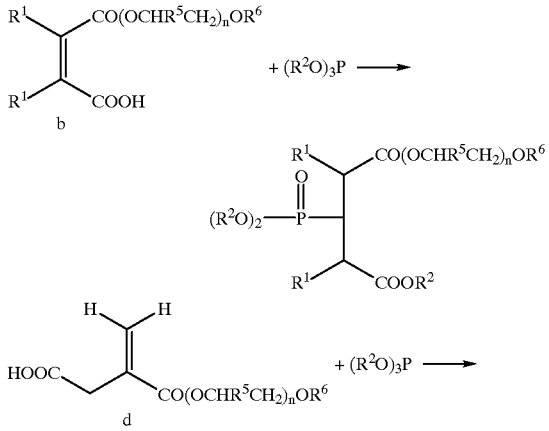

-continued

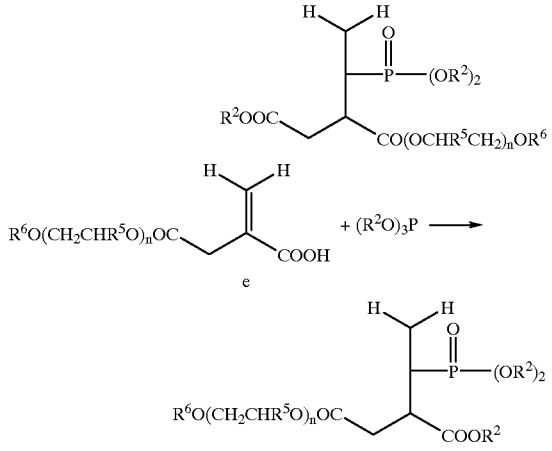

The following equations depict the formation of the carboxylic ester (A) by the reaction of the phosphite $(R^2O)_2PHO$ with the various intermediates that do not contain a free carboxylic group:

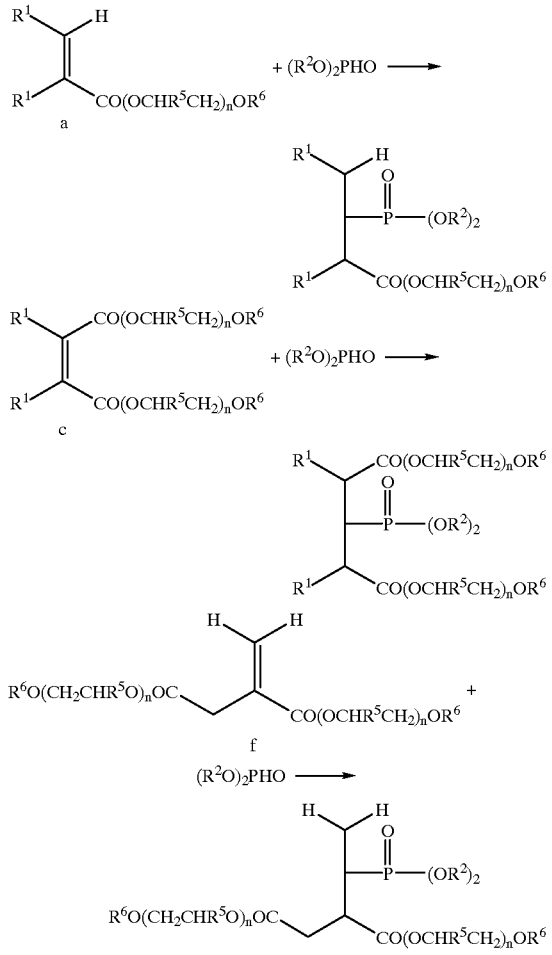

The following examples illustrate the preparation of various carboxylic esters (A). Unless otherwise indicated percentages are by weight.

EXAMPLE (A)-1

Charged to a 1 liter, 4 necked flask fitted with a stirrer, thermowell, nitrogen purge tube and cold water condenser vented to a caustic trap is 435 parts (1.04 moles) Tergitol 15-S-5 and 102 parts (1.04 moles) maleic anhydride. The contents are slowly heated to 55° C. with stirring and held at 55–60° C. for 1 hour. Then added is 0.4 parts sodium acetate which prevents the maleic acid which is obtained upon the opening of the maleic anhydride to isomerize to fumaric acid. The contents are then heated to 120° C. and held at this temperature for 2 hours. At 55° C. 176 parts (1.04 moles) triethyl phosphite is added dropwise over 1 hour. The addition is exothermic to 80° C. The contents are held at 55° C. for 1.5 hours and then filtered using a diatomaceous filtering aid. A product is obtained having a percent phosphorus of 4.5.

Examples (A)-2 to (A)-13 are prepared essentially according to the procedure of Example (A)-1 as per the reactants and mole ratio as outlined in Table I.

TABLE I

Preparation of the Carboxylic Ester (A)

| Example No. | Tergitol | Acid Source | Moles Tergitol: Moles Acid Source | Phosphite |
|---|---|---|---|---|
| (A)-2 | 15-S-3 | Maleic anhydride | 1:1 | Triethyl |
| (A)-3 | 15-S-7 | Maleic anhydride | 1:1 | Triethyl |
| (A)-4 | 15-S-12 | Maleic anhydride | 1:1 | Triethyl |
| (A)-5 | 15-S-12 | Maleic anhydride | 1:1 | Tributyl |
| (A)-6 | 15-S-13 | Acrylic acid | 1:1 | Dibutyl hydrogen |
| (A)-7 | 15-S-7 | Methacrytic acid | 1:1 | Dibutyl hydrogen |
| (A)-8 | 15-S-5 | Maleic acid | 2:1 | Dibutyl hydrogen |
| (A)-9 | 15-S-5 | Methylmaleic acid | 1:1 | Tributyl |
| (A)-10 | 15-S-3 | Methylmaleic acid | 2:1 | Dibutyl hydrogen |
| (A)-11 | 15-S-5 | Crotonic acid | 1:1 | Dibutyl hydrogen |
| (A)-12 | 15-S-3 | Itaconic acid | 1:1 | Triethyl |
| (A)-13 | 15-S-3 | Itaconic acid | 2:1 | Dibutyl hydrogen |

(B) The Rust Inhibitor

The compositions of this invention include at least one rust inhibitor (B) comprising (1) an amine acid salt or amide derived from (a) at least one acid comprising a carboxylic acid corresponding to the formula $$R^7(COOH)_{1-3}$$

wherein $R^7$ is an alkyl, alkylene, alkenylene, alkynylene, hydroxy alkyl or hydroxy alkylene group containing from 4 to 25 carbon atoms, and optionally (b) boric acid, with (c) at least one monoamine corresponding to the formula $$(R^8)_3N$$

wherein each $R^8$ is independently hydrogen, a $C_{1-21}$ hydrocarbyl or a $C_{2-21}$ hydroxy hydrocarbyl group;

(2) a nitrogen-containing, phosphorus-free carboxylic composition made by the reaction of (a) at least one polycarboxylic acid acylating agent having at least one hydrocarbon based substituent of 12 to 500 carbon atoms with (b) at least one (i) N-(hydroxyl-substituted hydrocarbyl) amine, (ii) hydroxyl-substituted poly (hydrocarbyloxy) analog of said amine or (iii) mixtures of (i) and (ii);

(3) an amine of the formula

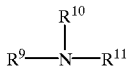

wherein each of $R^9$, $R^{10}$ and $R^{11}$ is individually selected from the group consisting of hydrogen atoms, hydrocarbyl radicals containing from 1 to 40 carbon atoms and hydroxy-substituted hydrocarbyl radicals containing from 1 to 40 carbon atoms provided that at least one of $R^9$, $R^{10}$ and $R^{11}$ is said hydrocarbyl or hydroxy-substituted hydrocarbyl radical; or (4) an alkoxylated amine of the formula

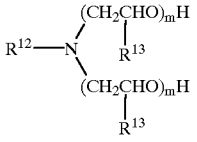

wherein $R^{12}$ is an aliphatic group containing from 8 to 28 carbon atoms, $R^{13}$ is independently hydrogen or methyl and m is an integer independently from 1 to 10.

(B1) The Amine Acid Salt or Amide

Components (B1) is an amine acid salt or amide. The reactants used to make the amine acid salt and the amide are identical. Amine acid salts are obtained when the reaction temperature is below 100° C. and amides are obtained when the reaction temperature is well in excess of 100° C. and water is removed.

The carboxylic acids (B1a) as one of the reactants is represented by the formula $$R^7(COOH)_{1-3}$$

wherein $R^7$ is an alkyl, alkylene, alkenylene, alkynlene or hydroxy alkylene group of from 4 to 25 carbon atoms and preferably from 4 to 15 carbon atoms. Usually the acid is a dicarboxylic acid, although monocarboxylic acids and tricarboxylic acids are useful. As dicarboxylic acids, $R^7$ is an alkylene group. Typical alkylene groups are the butylene groups such as the 1,2-, 1,3- and 1,4 linear butylene groups, the branched butylene groups and higher homologs thereof up to groups containing about 25 carbon atoms. Often $R^7$ is an unbranched polymethylene group such as 1,5-pentylene group, 1,6-hexamethylene group, 1,7-heptylene group, etc.

The alkenylene groups are analogous to the alkylene groups except that they contain a double bond. The hydroxy alkylene groups are similarly analogous to the alkylene groups except that a single hydroxy group is present.

Typically $R^7$ is an unbranched polymethylene group; often it is an alkylene group of 4 to 10 carbon atoms or a polymethylene group of similar size. Specific examples of carboxylic acids (B1a) are lauric acid, myristic acid, palmitic acid, stearic acid, oleic acid, linoleic acid, linolenic acid, sebacic acid, azelaic acid, suberic acid, pimelic acid, adipic acid, glutaric acid, 1,12-dodecanedioic acid, 1,16-hexadecanedioic acid, various commercial dicarboxylic acids such as a linoleic acrylic dimer available from Westvaco Chemical Co. under the general trade designation "1550 Diacid", 1,2,4-dodecanetrioic acid and the like. Dodecandioic acid, sebacic acid, azealic acid and mixtures of one or more of these acids are the preferred dicarboxylic acids. Mixtures of two or more such acids can also be successfully used.

An optional component that may be utilized in the preparation of the amine acid salt or amide (B1) is boric acid (B1b). Any of the various forms of boric acid may be used, including metaboric acid ($HBO_2$), orthoboric acid ($H_3BO_3$) and tetraboric acid ($H_2B_4O_7$). Boron trioxide ($B_2O_3$) may be employed as a source of boric acid. Boron trioxide will react first with water which is present in the reaction mixture to form boric acid, which then reacts further.

The monoamines (B1c) useful in preparing the amine acid salt or amide (B1) can be represented by the general formula $$(R^8)_3N$$

wherein each $R^8$ is independently hydrogen, a $C_{1-20}$ hydrocarbyl or a $C_{2-20}$ hydroxy hydrocarbyl group. When all the $R^8$ groups are hydrogen, the amine is ammonia. In other instances the amine is a primary, secondary or tertiary amine. The hydrocarbyl groups may contain from 1 to 20 carbon atoms, but preferably will contain 1 to 3 or 4 carbon atoms. Preferably, at least one $R^8$ is a hydroxy alkyl group, and each hydrocarbyl group also will preferably have no more than 3 or 4 carbon atoms. Specific examples of such hydroxy alkyl amines are ethanolamine, diethanolamine, triethanolamine, propanolamine, dipropanolamine, tripropanolamine, N,N-di(lower alkyl) ethanol or propanolamine (where the alkyl group has up to seven carbon atoms) and the like. With the propanolamines, both the 1,2- and 1,3-isomers are contemplated.

The monoamine (B1c) can be aliphatic, alicyclic, aromatic or heterocyclic in nature. These include aliphatic-substituted aromatic, aliphatic-substituted alicyclic, aliphatic-substituted heterocyclic, alicyclic-substituted aliphatic, alicyclic-substituted aromatic, alicyclic-substituted heterocyclic, aromatic-substituted aliphatic, aromatic-substituted alicylic, aromatic-substituted heterocyclic, heterocyclic-substituted aliphatic, heterocyclic-substituted alicyclic, and heterocyclic-substituted aromatic amines which may be saturated or unsaturated. If unsaturated, the amine will be free from acetylenic unsaturation (i.e., —C≡C—).

Aliphatic monoamines include mono-, di- and trialiphatic substituted amines wherein the aliphatic groups can be saturated or unsaturated and straight or branched chain. Thus, they are primary, secondary or tertiary aliphatic amines. Such amines include, for example, mono-, di- and trialkyl-substituted amines, mono-, di- and trialkenyl-substituted amines, and amines having one or two N-alkenyl substituents, one or two N-alkyl substituents and the like. The total number of carbon atoms in these aliphatic monoamines will normally not exceed about 40 and usually not exceed about 20 carbon atoms. Specific examples of such monoamines include methylethylamine, diethylamine, n-butylamine, di-n-butylamine, tri-n-butylamine, allylamine, isobutylamine, cocoamine, stearylamine, laurylamine, methyllaurylamine, oleylamine, N-methyl-N-octylamine, dodecylamine, octadecylamine, and the like. Examples of alicyclic-substituted aliphatic amines, aromatic-substituted aliphatic amines, include 2-(cyclohexyl)ethylamine, benzylamine, phenylethylamine, 3-(furylpropyl)amine and the like.

Alicyclic monoamines are those monoamines wherein there is an alicyclic substituent attached directly to the amino nitrogen through a carbon atom in the cyclic ring structure. Examples of alicyclic monoamines include cyclohexylamine, cyclopentylamine, cyclohexenylamine, cyclopentenylamines, N-ethylcyclohexylamine, dicyclohexylamine, and the like. Examples of aliphatic-substituted, aromatic-substituted, and heterocyclic-substituted alicyclic mono-amines include propyl-substituted cyclohexylamines, phenyl-substituted cyclopentylamines, and pyranyl-substituted cyclohexylamine.

Suitable aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthylene. Examples of aromatic monoamines include aniline, di(-para-ethylphenyl) amine, naphthylamine, N-(n-butyl)aniline, and the like. Examples of aliphatic-substituted, alicyclic-substituted, and heterocyclic-substituted aromatic monoamines are para-ethylaniline, para-dodecylaniline, cyclohexyl-substituted amine, and thienyl-substituted aniline.

Heterocyclic mono-amines can also be used in making the carboxylate salts of this invention. As used herein, the terminology "heterocyclic mono-amines(s)" is intended to describe those heterocyclic amines containing at least one primary or secondary amino group and at least one nitrogen as a heteroatom in a heterocyclic ring. Heterocyclic amines can be saturated or unsaturated and can be substituted with alkyl, alkenyl, aryl, alkaryl or aralkyl substituents. Generally, the total number of carbon atoms in the substituents will not exceed about 20. Heterocyclic amines can contain heteroatoms other than nitrogen, especially oxygen and sulfur. Obviously they can contain more than one nitrogen hetero-atom. The five- and six-membered heterocyclic rings are preferred.

Among the suitable heterocyclics are aziridines, azetidines, azolidines, pyrrolidine, pyridine, tetra- and di-hydropyridines, pyrroles, indoles, quinoline, picolines, piperidine and the like. Mixtures of two or more of these heterocyclic amines can be used. Typical heterocyclic amines the saturated five- and six-membered heterocyclic rings a re the saturated five- and six-membered heterocyclic amines.

As will be appreciated by those of skill in the art, when the monoamine (B1c) is an alicyclic or heterocyclic amine, two (or more) of the R' groups can be joined together. As noted above hydroxyl substituted analogs of all the above-described monoamines can be also used in the invention. Similarly mixtures of such analogs and mixtures of one or more analogs with one or more of the above-described monoamines can be used.

The Reaction of the Carboxylic Acid (B1a), the Optional Boric Acid (B1b) and the Monoamine (B1c)

The amine acid salts or amides (B1) of this invention are formed by neutralizing the carboxylic acid (B1a) and the optional boric acid (B1b) with the monoamine (B1c). This reaction can be carried out by adding the carboxylic acid(s) and optional boric acid(s) and the amine(s).

Usually about one mole of amine (B1c) is included for each equivalent of carboxylic acid (B1a) (an equivalent of acid is its molecular weight divided by the number of carboxylic groups in the structure) and of boric acid in the reaction mixture. In determining acid equivalent weight, an anhydride group, if present, is counted as two carboxylic groups. Thus the amount of amine used in the reaction generally will be an amount in slight excess of that needed to neutralize all of the carboxylic acid and boric acid present. For example, in preparing an amine acid salt, the present invention contemplates the use of mixtures comprising 15–30% by weight of carboxylic acid, 0–20% by weight of boric acid, 40–55% by weight of mono amine with the remainder being water.

The amine acid salts of this invention are prepared by mixing the reactants in water at temperatures below 100° C. Generally temperatures of from 60–75° C. are sufficient for producing the amine acid salts.

The following examples more fully describe the preparation of the amine acid salts that contain boric acid. These examples are intended to be merely illustrative and should not be construed as being limiting in any way. Unless otherwise indicated, all parts and percentages are by weight, and all temperatures are in degrees centigrade.

EXAMPLE (B1)-1

A mixture of 405 parts of boric acid and 800 parts of water is prepared, and 1333 parts of ethanolamine are added over a period of 30 minutes. The temperature of the mixture rises to about 60° C. and is maintained at 62° C.–65° C. for an additional 45 minutes. Dodecanedioic acid (533 parts), 155 parts of sebacic acid and 251 parts of azealic acid are added to the mixture in 12 minutes and the temperature of the mixture reaches 72° C. Ethanolamine (523 parts) is added over a period of 18 minutes and the mixture is maintained at 65° C.–72° C. for one hour. The mixture is cooled and filtered. The filtrate is the desired product.

EXAMPLE (B1)-2

A mixture of 188 parts of water and 313 parts of monoethanolamine is prepared and heated to about 52° C. whereupon 95 parts of boric acid is added over 30 minutes. A slightly exothermic reaction occurs and the temperature is kept below about 65° C. during addition and thereafter for about 45 minutes. Dodecanedoic acid (125 parts), sebacic acid (36.4 parts) and azelaic acid (59 parts) are added in the listed order while maintaining the temperature of the mixture between about 65° C.–70° C. Upon completion of the addition of the azelaic acid, an additional 123 parts of monoethanolamine are added over 15 minutes followed by mixing for one hour. The mixture then is filtered, and the filtrate is the desired product containing 1.84% of boron and 10.32% nitrogen.

EXAMPLE (B1)-3

A mixture of 40.2 parts of boric acid and 60 parts of water is charged to a reactor and heated to 45° C. Monoethanolamine (119 parts) is added in 20 minutes, and the reaction is exothermic to a temperature of 57° C. The mixture is maintained at a temperature of from 57° C.–62° C. for about 45 minutes whereupon 33 parts of dodecanedioic acid and 14.4 parts of sebacic acid are added. The temperature of the reaction mixture increases to 69° C., and 33.4 parts of monoethanolamine are added. The mixture then is maintained at a temperature of about 67° C.–71° C. for one hour and yields the desired product.

EXAMPLE (B1)-4

A mixture of 40.2 parts of boric acid and 60 parts of water is heated to about 45° C. whereupon 119 parts of monoethanolamine are added over a period of about 15 minutes. The temperature of the reaction mixture reaches 64° C. during the addition and is maintained at a temperature of from 60°–64° C. for about 30 minutes. To this mixture, there is added 26.7 parts of dodecanedioic acid, 8.1 parts of sebacic acid, 12.6 parts of azelaic acid and 33.3 parts of monoethanolamine. The exothermic reaction raises the temperature to 72° C., and the mixture is maintained at a temperature of from 60°–72° C. for about 15 minutes. Upon cooling, the desired product is obtained.

EXAMPLE (B1)-5

A mixture of 25.2 parts of boric acid and 126 parts of diethanolamine is heated to and maintained at a temperature of 85°–90° C. for one hour whereupon 33.3 parts of dodecanedioic acid, 9.9 parts of sebacic acid and 15.9 parts of azelaic acid are added. After a period of about five minutes, 39.9 parts of ethanolamine are added, and the reaction is exothermic to a temperature of 95° C. The mixture is maintained at 90°–95° C. for about one hour, 49.8 parts of water are added, and the mixture is cooled to yield the desired product.

EXAMPLE (B1)-6

Charged to a vessel is 1000 parts water. Stirring is begun and 917.5 parts monoethanolamine is added while maintaining the temperature at below 52° C. After the completion of the menoethanolamine, the temperature is adjusted to 52°–57° C. and added in sequence are 150 parts boric acid, 245 parts dodecanedioic acid, 72.5 parts sebacic acid and 115 parts azelaic acid while maintaining the batch temperature below 68° C. The contents are stirred at this temperature for 1 hour. The contents are cooled to 38° C. and filtered to give the desired product.

EXAMPLE (B1)-7

The procedure of Example (B1)-3 is repeated except that 48 parts of dodecanedioic acid are utilized and the sebacic acid is omitted from the reaction mixture.

EXAMPLE (B1)-8

The procedure of Example (B1)-7 is repeated except that the ethanolamine is replaced by an equivalent amount of diethyl amine.

EXAMPLE (B1)-9

The procedure of Example (B1)-8 is repeated except that the diethanolamine is replaced by an equivalent amount of isopropanol amine.

The following examples are directed to amine acid salts without boric acid.

EXAMPLE (B1)-10

Added to a vessel are 38.0 parts triethanolamine. Stirring is begun and added is 4.5 parts monoethanolamine and 13.0 parts water. The temperature rises to 32° C. and the contents are stirred for 0.1 hour at which time the following is added: 37.5 parts isononanoic acid and 7.0 parts sebacic acid. The temperature rises to 50° C. and after approximately 0.1 hour the contents are heated to 60° C. and held at this temperature for 1.5 hours. The contents are filtered to give the desired product.

EXAMPLE (B1)-11

Added to a vessel are 63.5 parts triethanolamine, 1.0 part monoethanolamine and 17.9 parts water. The contents are stirred for 0.3 hours and the temperature increases to 32° C. Added with continued stirring is 13.5 parts dodecanedioic acid, 3.5 parts isononanoic acid and 0.6 parts neodecanoic acid. The temperature is increased to 60° C. and held at this temperature for 1.5 hours. The contents are filtered to give the desired product.

EXAMPLE (B1)-12

Added to a vessel are 38.2 parts triethanolamine, 23.2 parts diethanolamine and 0.5 parts monoethanolamine. Stirring is begun and 21.4 parts water is added and the temperature increases to 32° C. After stirring for 0.1 hours, added are 12.6 parts dodecanedioic acid, 3.5 parts isononanoic acid and 0.6 parts neodecanoic acid. The contents are heated to 60° C. and held at this temperature for 1.5 hours. The contents are filtered to give the desired product.

EXAMPLE (B1)-13

Added to a vessel are 21.5 parts water. While stirring the following is added: 38.0 parts aminoethylethanolamine, 15.75 parts dodecanedioic acid, 9.0 parts neodecanoic acid and 15.75 parts isononanoic acid. The temperature is increased to 60° C. and held at this temperature for 1 hour. The contents are filtered to give the desired product.

The following examples are directed to the preparation of amides.

EXAMPLE (B1)-14

Added to a vessel is 57.5 parts tall oil fatty acid. The contents are stirred and while sweeping with a stream of nitrogen, slowly added is 42.5 parts diethanolamine. When the addition is complete, the temperature is increased to 115° C. and held at this temperature for 2.5 hours. Water is removed by vacuum distillation and the temperature is then increased 5° C. every hour with the contents held each time at that temperature for one hour. The maximum temperature is 140° C. The vacuum is removed and the contents are cooled to 40°–60° C. and filtered to give the desired product.

EXAMPLE (B1)-15

The procedure of Example (B1)-14 is essentially followed except that the tall oil fatty acid is replaced with 74.4 parts stearic acid and 25.6 parts diethanolamine is employed.

(B2) The Nitrogen-Containing Phosphorus-Free Carboxylic Compositions

The nitrogen-containing, phosphorus-free carboxylic composition (B2) is made by the reaction of (a) at least one polycarboxylic acid acylating agent having at least one hydrocarbon based substituent of 12 to 500 carbon atoms with (b) at least one (i) N-(hydroxyl-substituted hydrocarbyl) amine, (ii) hydroxyl substituted poly(hydrocarbyloxy) analog of said amine or (iii) mixtures of (i) and (ii).

The acylating agent used in making the compositions (B2) of the present invention are well known to those of skill in the art and have been found to be useful as additives for lubricants and fuels and as intermediates for preparing the same. See, for example, the following U.S. patents which are hereby incorporated by reference for their disclosures relating to carboxylic acid acylating agents: U.S. Pat. Nos. 3,219,666; 3,272,746; 3,381,022; 3,254,025; 3,278,550; 3,288,714; 3,271,310; 3,373,111; 3,346,354; 3,272,743; 3,374,174; 3,307,926; and 3,394,179.

Generally, these carboxylic acid acylating agents are prepared by reacting an olefin polymer or chlorinated analog thereof with an unsaturated carboxylic acid or derivative thereof such as acrylic acid, fumaric acid, maleic anhydride and the like. Often they are polycarboxylic acylating agents such as hydrocarbyl-substituted succinic acids and anhydrides. These acylating agents have at least one hydrocarbyl-based substituent of about 12 to about 500 carbon atoms. Generally, this substituent has an average of about 20, typically 30, to about 300 carbon atoms; often it has an average of about 50 to about 250 carbon atoms.

As noted above, the hydrocarbon-based substituents present in the acylating agents of this invention may be derived from olefin polymers or chlorinated analogs thereof. The olefin monomers from which the olefin polymers are derived are polymerizable olefins and monomers characterized by having one or more ethylenic unsaturated groups. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group $>C{=}CH_2$. However, certain internal olefins can also serve as monomers (these are sometimes referred to as medial olefins). When such medial olefin monomers are used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl groups such as para(tertiary butyl)phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally the olefin polymers are homo- or interpolymers of terminal hydrocarbyl olefins of about two to about 16 carbon atoms. A more typical class of olefin polymers is selected from that group consisting of homo- and interpolymers of terminal olefins of two to six carbon atoms, especially those of two to four carbon atoms.

Specific examples of terminal and medial olefin monomers which can be used to prepare the olefin polymers from which the hydrocarbon-based substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2 pentadiene-1,3, isoprene, hexadiene-1,5, 2-chlorobutadiene-1,3, 2-methylheptene-1,3-cyclohexylbutene-1, 3,3-dimethylpentene-1, styrene, divinylbenzene, vinylacetate allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutene)s such as obtained by polymerization of a $C_4$ refinery stream having a butene content of about 35 to about 75 percent by weight and an isobutene content of about 30 to about 60 percent by weight in the presence of a Lewis acid catalyst such as aluminum chloride or boron trifluoride. These polyisobutenes contain predominantly (that is, greater than 80% of the total repeat units) isobutene repeat units of the configuration

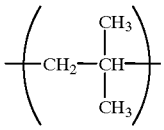

Typically, the hydrocarbyl-based substituent in the carboxylic acid acylating agent as used in the present invention is a hydrocarbyl, alkyl or alkenyl group of about 12 to about 500 carbon atoms which can be represented as $R^{14}$. Useful acylating agents include substituted succinic acid agents containing hydrocarbyl-based substituents of about 30–500 carbon atoms.

Often the agents (B2a) used in making the compositions (B2) are substituted succinic acids or derivatives thereof which can be represented by the formula:

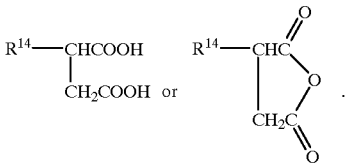

Such succinic acid acylating agents can be made by the reaction of maleic anhydride, maleic acid, or fumaric acid with the aforedescribed olefin polymer, as is shown in the patents cited above. Generally, the reaction involves merely heating the two reactants at a temperature of about 150° to about 200°. Mixtures of the aforesaid polymeric olefins, as well as mixtures of unsaturated mono- and dicarboxylic acids can also be used.

The N-(hydroxyl-substituted hydrocarbyl Amine (B2b)

The hydroxyl hydrocarbyl amines of the present invention generally have one to about four, typically one or two hydroxyl groups per molecule. These hydroxyl groups are each bonded to a hydrocarbyl group to form a hydroxyl-substituted hydrocarbyl group which, in turn, is bonded to the amine portion of the molecule. These N-(hydroxyl-substituted hydrocarbyl) amines can be monoamines or polyamines and they can have a total of up to about 40 carbon atoms; generally they have a total of about 20 carbon atoms. Typically, however, they are monoamines or polyamines and they can have a total of up to about 40 carbon atoms; generally they have a total of about 20 carbon atoms. These amines can be primary, secondary or tertiary amines while the N-(hydroxyl-substituted hydrocarbyl) polyamines can have one or more of any of these types of amino groups. Mixtures of two or more of any of the aforedescribed amines (B2b) can also be used to make the carboxylic composition (B2).

Specific examples N-(hydroxyl-substituted hydrocarbyl) amines suitable for use in this invention are the N-(hydroxy-lower alkyl)amines and polyamines such as 2-hydroxyethylamine, 3-hydroxybutylamine, di-(2-hydroxyethyl)amine, 3-hydroxybutylamine, di-(2-hydroxyethyl)amine, tri-(2-hydroxyethyl)amine, di-(2-hydroxypropyl)amine, N,N,N'-tri-(2-hydroxyethyl) ethylenediamine, N,N,N',N'-tetra(2-hydroxyethyl) ethylenediamine, N-(2-hydroxyethyl)piperazine, N,N'-di-(3-hydroxypropyl)piperazine, N-(2-hydroxyethyl) morpholine, N-(2-hydroxyethyl)-2-morpholinone, N-(2-hydroxyethyl)-3-methyl-2-morpholinone, N-(2-hydroxypropyl)-6-methyl-2-morpholinone, N-(2-hydroxyethyl)-5-carbethoxy-2-piperidone, N-(2-hydroxypropyl)-5-carbethoxy-2-piperidone, N-(2-hydroxyethyl)-5-(N-butylcarbamyl)-2-piperidone, N-(2-hydroxyethyl)piperidine, N-(4-hydroxybutyl)piperidine, N,N-di-(2-hydroxyethyl)glycine, and ethers thereof with aliphatic alcohols, especially lower alkanols, N,N-di)3-hydroxypropyl) glycine, and the like.

Further amino alcohols are the hydroxy-substituted primary amines described in U.S. Pat. No. 3,576,743 by the general formula $$R^{15}{-}NH_2$$

where $R^{15}$ is a monovalent organic radical containing at least one alcoholic hydroxy group, according to this patent, the total number of carbon atoms in $R^{15}$ will not exceed 20.

Hydroxy-substituted aliphatic primary amines containing a total of up to about 10 carbon atoms are useful. Generally useful are the polyhydroxy-substituted alkanol primary amines wherein there is only one amino group present (i.e., a primary amino group) having one alkyl substituent containing up to 10 carbon atoms and up to 4 hydroxyl groups. These alkanol primary amines correspond to $R^{15}NH_2$ wherein $R^{15}$ is a mono- or polyhydroxy-substituted alkyl group. It is typical that at least one of the hydroxyl groups be a primary alcoholic hydroxy group. Trismethylolaminomethane is a typical hydroxy-substituted primary amine. Specific examples of the hydroxy-substituted primary amines include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(betahydroxypropyl)-N'-beta-aminoethyl)piperazine, 2-amino-1-butanol, ethanolamine, beta-(betahydroxy ethoxy)-ethylamine, glucamine, glusoamine, 4-amino-3-hydroxy-3-methyl-1-butene (which can be prepared according to procedures known in the art by reacting isopreneoxide with ammonia), N-3-(aminopropyl)-4(2-hydroxyethyl)-piperadine, 2-amino-6-methyl-6-heptanol, 5-amino-1-pentanol, N-(beta-hydroxyethyl)-1,3-diaminopropane, 1,3-diamino-2-hydroxy-propane, N-(beta-hydroxy ethoxyethyl)-ethylenediamine, and the like. For further description of the hydroxy-substituted primary amines useful as the N-(hydroxyl-substituted hydrocarbyl) amines in this invention see U.S. Pat. No. 3,576,743 which is expressly incorporated herein by reference for its disclosure of such amines.

Typically, the amine (B2b) is a primary, secondary or tertiary alkanol amine or mixture thereof. Such amines can be represented, respectively, by the formulae:

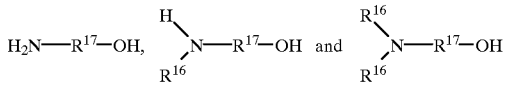

wherein each $R^{16}$ is independently a hydrocarbyl group of one to about eight carbon atoms or hydroxyl-substituted hydrocarbyl group of two to about eight carbon atoms and $R^{17}$ is a divalent hydrocarbyl group of about two to about eighteen carbon atoms. The group —$R^{17}$—OH in such formulae represents the hydroxyl-substituted hydrocarbyl group. $R^{17}$ can be an acyclic, alicyclic or aromatic group. Typically, it is an acyclic straight or branched alkylene group such as an ethylene, 1,2-propylene, 1,2-butylene, 1,2-octadecylene, etc. group. Where two $R^{16}$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, oxazolidines, -thiazolidines and the like. Typically, however, each R is a lower alkyl group of up to 7 carbon atoms.

The amine (B2b) can also be an ether N-(hydroxyl-substituted hydrocarbyl) amine. These are hydroxyl-substituted poly(hydrocarbyloxy) analogs of the above-described amines (these analogs also include hydroxyl-substituted oxyalkylene analogs). Such amines can be conveniently prepared by reaction of epoxides with aforedescribed amines and can be represented by the formulae:

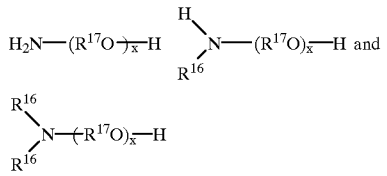

wherein X is a number from 2 to about 15 and $R^{16}$ and $R^{17}$ are as described above.

Polyamine analogs of these alkanol amines, particularly alkoxylated alkylene polyamines (e.g., N,N-(diethanol) ethylenediamine) can also be used to make the compositions of this invention. Such polyamines can be made by reacting alkylene amines (e.g., ethylene diamine) with one or more alkylene oxides (e.g., ethylene oxide, octadecene oxide) of two to about twenty carbons. Similar alkylene oxide-alkanol amine reaction products can also be used such as the products made by reacting the aforedescribed primary, secondary or tertiary alkanol amines with ethylene, propylene or higher epoxides in a 1:1 or 1:2 molar ratio. Reactant ratios and temperatures for carrying out such reactions are known to those skilled in the art.

Specific examples of alkoxylated alkylene polyamines include N-(2-hydroxyethyl)ethylenediamine, N,N-bis(2-hydroxyethyl)-ethylenediamine, 1-(2-hydroxyethyl) piperazine, mono(hydroxypropyl)-substituted diethylenetriamine, di(hydroxypropyl)-substituted diethylenetriamine, di(hydroxypropyl)-substituted tetraethylenepentamine, N-(3-hydroxybutyl)-tetramethylenediamine, etc. Higher homologs obtained by condensation of the above-illustrated hydroxy alkylene polyamines through amino radicals or through hydroxy radicals are likewise useful. Condensation through amino radicals results in a higher amine accompanied by removal of ammonia while condensation through the hydroxy radicals results in products containing ether linkages accompanied by removal of water. Mixtures of two or more of any of the aforedescribed mono- or poly-amines are also useful.

Particularly useful examples of N-(hydroxyl-substituted hydrocarbyl)amines (B2b) include mono-, di-, and triethanolamine, diethylethanolamine, di-(3-hydroxyl propyl)amine, N-(3-hydroxyl butyl)amine, N-(4-hydroxyl butyl)amine, N,N-di-(2 -hydroxyl propyl)amine, N-(2-hydroxyl ethyl) morpholine and its thio analog, N-(2-hydroxyl ethyl) cyclohexylamine, N-3-hydroxyl cyclopentylamine, o-, m- and p-amino-phenol, N-(hydroxyl ethyl) piperazine, N,N'-di(hydroxyl ethyl) piperazine, and the like. Preferred amines are diethylethanolamine, dimethylethanolamine, and ethanolamine and mixtures thereof.

The Reaction of the Acylating Agent (B1a) with the Hydroxyl Amine (B2b) to form the Nitrogen-Containing Carboxylic Composition (B2)

The reaction of the acylating agent (B2a) with the hydroxyl amine (B2b) can be carried out at temperatures ranging from about 30° C. to the decomposition temperature of the reaction components and/or products having the lowest such temperature. Generally it is carried out at a temperature in the range of about 50° to about 150°; but usually at a temperature below about 100°. Often the reaction is carried out under ester-forming conditions and the product thus formed is, for example, an ester, salt, amide, imide, amic ester or mixture of such products. The salt may be an internal salt, wherein one of the carboxyl groups becomes ionically bound to a nitrogen atom within the same group or it may be an external salt wherein the ionic salt group is formed with a nitrogen atom which is not part of the same group forming the ester group. Mixtures of acylating agents and/or mixtures of hydroxyl amines can be used.

Generally, the ratio of acylating agent to N-(hydroxyl-substituted hydrocarbyl)amine is in the range of 0.5 to about 3 moles of amine (B2b) per equivalent of acylating (B2a). An equivalent of acylating agent (B2a) can be determined by dividing its molecular weight by the number of carboxyl functions present. These can usually be determined from the structural formula of the acylating agent or empirically through well-known titration procedures. For example, a succinic acid anhydride or di(alkyl) ester acylating agent has an equivalent weight of one-half its molecular weight.

In addition to the acylating agent (B2a) there may also be present in the composition-forming reaction mixture one or more lower molecular weight mono- or poly-carboxylic acid acylating agents of one to about less than 18 carbon atoms such as fatty acids having 10 to about 18 carbon atoms or a tetrapropenyl-substituted succinic anhydride. In such cases the moles of lower acylating present will be at least less than those of the acylating agent (B2a) and the total equivalents of lower acylating agent plus acylating agent (B2a) will still fall within the aforedescribed ratios.

Typical lower (MW) monocarboxylic acylating agents include saturated and unsaturated fatty acids, such as lauric acid, stearic acid, oleic acid, myristic acid, linoleic acid, and the like. Anhydrides, when available, and lower alkyl esters of these acids can also be used. Mixtures of two or more such agents can also be successfully used. An extensive discussion of such acids is found in Kirk-Othmer "Encyclopedia of claimed Technology" 2nd Edition, 1965, John Wiley & Sons New York pages 811–856. Acylating agents including acetic acid, propionic acid, butyric acid, acrylic and benzoic acid as well as their anhydrides and lower alkyl esters are also useful.

Among the useful lower Mw polycarboxylic acylating agents are maleic acid, fumaric acid, itaconic acid, mesaconic acid, succinic acid phthalic acid, alkyl-substituted phthalic acids, isophtahalic acid, malonic acid, glutaric acid, adipic acid, citraconic acid, glutaconic acid, chloromaleic acid, itaconic acid, scorbic acid, etc. Again anhydrides, when available, and lower alkyl esters and esters of these acids can be used as lower Mw acylating agents.

Certain substituted succinic acid and anhydride lower Mw acylating agents can also be used. A number of these are discussed in the above-cited Kirk-Othmer article at pages 847–849. The typical such acylating agents can be represented by the formula:

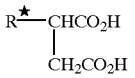

wherein R* is a hydrocarbyl group containing from 1 to 10 carbon atoms. Preferably, R* is an aliphatic or alicyclic hydrocarbyl group less than 10% of its carbon-to-carbon bonds unsaturated. Examples of such groups are 4-butylcyclohexyl, di(isobutyl), decyl, etc. The production of such substituted succinic acids and their derivatives with a halohydrocarbon is well known to those of skill in the art and need not be discussed in detail at this point.

Acid halides of the aforedescribed lower Mw mono- and polycarboxylic acids can be used as lower Mw acylating agents in this invention. These can be prepared by the reaction of such acids or their anhydrides with halogenating agents such as phosphorus tribromide, phosphorus pentachloride, phosphorus oxychloride, or thionyl chloride. Esters of such acids can be prepared simply by the reaction of the acid, acid halide or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

The reaction of acylating agent and hydroxy amine can be carried out in the presence of a normally liquid, substantially inert, organic solvent/diluent such as benzene, octane, and commercial mixtures such as the various textile spirits and naphthas. Mineral oils in small amounts can also be used. Such solvent/diluents aid in temperature control, viscosity control and the like. Often, however, when the reactants are sufficiently fluid such solvent/diluents are not used and the reaction is carried out in the absence of any materials other than the acylating agent (B2a) and the hydroxyl amine (B2b).

The following are specific examples for the preparation of Component (B2). In these examples all parts, percentages and ratios are by weight and all temperatures are in degrees Celsius unless expressly stated to the contrary, as is the case throughout this specification and appended claims.

EXAMPLE (B2)-1

To 6720 parts of a poly(isobutene)-substituted succinic anhydride (having a molecular weight of 1120), heated to 90° with stirring, is slowly added over 1.5 hours 702 parts of diethylethanolamine. This intermediate mixture is heated for an additional 0.5 hour at 90° and then 366 parts of monoethanolamine is added. The mixture is held at 90° for a final 0.5 hour and cooled to provide the desired product.

EXAMPLE (B2)-2

To a charge of 224 parts of the succinic anhydride described in Example (B2)-1, heated in a resin kettle with stirring at about 90°, is slowly added over a two hour period 468 parts of diethylethanolamine. Heating is continued for an additional hour at 90°. The desired carboxylic composition is a viscous, brownish liquid at room temperature.

(B3) The Amine

The amine compounds useful as (B3) of this invention are monoamines of the formula

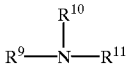

wherein each of $R^9$, $R^{10}$ and $R^{11}$ is individually selected from the group consisting of hydrogen atom, hydrocarbyl radicals containing from 1 to about 40 carbon atoms and hydroxy-substituted hydrocarbyl radicals containing from 1 to about 40 carbon atoms provided, however, that at least one of $R^9$, $R^{10}$ and $R^{11}$ is said hydrocarbyl or hydroxy-substituted hydrocarbyl radical.

Among the amine compounds useful as component (B3) of this invention are monoamines that can be primary, secondary or tertiary monoamines. The monoamines are generally substituted with hydrocarbyl radicals containing from 1 to about 40 carbon atoms. Generally these hydrocarbyl radicals are aliphatic radicals free from acetylenic unsaturation and contain from 1 to about 10 carbon atoms.

Among the monoamines useful in making the salts useful in this invention are those of the formula $HNR^9R^{10}$ wherein $R^9$ is an alkyl radical of up to 10 carbon atoms and $R^{10}$ is hydrogen atom or an alkyl radical of up to 20 carbon atoms. Other monoamines are aromatic monoamines of the general formula $HNR^9R^{10}$ wherein $R^9$ is a phenyl, alkylated phenyl, naphthyl or alkylated naphthyl radical of up to 10 carbon atoms and $R^{10}$ is a hydrogen atom, an alkyl radical of up to 10 carbon atoms, or a radical similar to $R^9$. Examples of suitable monoamines are the ethylamine, diethylamine, n-butylamine, di-n-butylamine, allylamine, isobutylamine, cocoamine, stearylamine, laurylamine, methyllaurylamine, oleylamine, aniline, methylaniline, N-methylaniline, di-phenylamine, benzylamine, tolylamine and methyl-2-cyclohexylamine.

Hydroxy amines are also included in the class of useful monoamines. Such compounds are the hydroxy-substituted hydrocarbyl analogs of the aforedescribed monoamines. Hydroxy monoamines useful in this invention have the formula $NR^9R^{10}R^{11}$, wherein $R^9$ is an alkyl or hydroxy-substituted alkyl radical of up to 12 carbon atoms. $R^{10}$ and $R^{11}$ are independently a hydrogen atom or a radical similar to $R^9$. $R^9$ can be a hydroxy-substituted phenyl, alkylated phenyl, naphthyl or alkylated naphthyl radical of up to 10 carbon atoms, and $R^{10}$ and $R^{11}$ are independently a hydrogen atom or a radical similar to $R^9$, at least one of $R^9$, $R^{10}$ and $R^{11}$ being hydroxy-substituted.

Suitable hydroxy-substituted monoamines include ethanolamine, di-3-propanolamine, 4-hydroxybutylamine, diethanolamine, N-methyl-2-propanolamine, 3-hydroxyaniline, triethanolamine, diethylethanolamine, dimethylethanolamine, tris(hydroxymethyl)methylamine and the like.

Cyclic monoamines are also useful in making the compositions of this invention. The cyclic ring can also incorporate unsaturation and can be substituted with hydrocarbyl radicals such as alkyl, alkenyl, aryl, alkaryl or aralkyl. In addition, the ring can also contain other hetero atoms such as oxygen, sulfur or other nitrogen atoms including those not having hydrogen atoms bonded to them. Generally, these rings have 3–10, preferably 5 or 6, ring members. Among such cyclic monoamines are aziridines, azetidines, azolidines, pyridines, pyrroles, piperidines, indoles, isoindoles, morpholines, thiamorpholines, azepines and tetrahydro-, dihydro- and perhydro-derivatives of each of the above.

(B4) The Alkoxylated Amine

The alkoxylated amine is of the formula

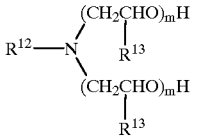

wherein $R^{12}$ is an aliphatic group containing from 8 to 28 carbon atoms, $R^{13}$ is independently hydrogen or methyl and m is an integer independently from 1 to 20. Preferably $R^{12}$ is an alkyl group containing from 8 to 28 carbon atoms and $R^{13}$ is hydrogen.

The above described alkoxylated amine is prepared by reacting a primary amine with an alkylene oxide comprising ethylene oxide or propylene oxide. Preferred is ethylene oxide. The below equation shows the formation of alkoxylated amines:

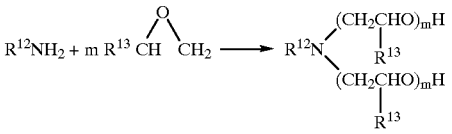

The number of moles of alkylene oxide is signified by "m". The alkylene oxide units range from 1 to 20 and preferably from 5 to 15.

Useful alkoxylated amines are available from Sherex Chemicals. For example, Varonic® T205 is tallow amine ethoxylated with 5 moles of ethylene oxide. Varonic® T210 is tallow amine ethoxylated with 10 moles of ethylene oxide and Varonic® 215 is tallow amine ethoxylated with 15 moles ethylene oxide.

Ethoxylated amines are also available from Akzo Corporation. The number in parenthesis indicates the number of moles of ethylene oxide; Ethomeen C/15-ethoxylated (5) cocoalkylamine, Ethomeen C/20-ethoxylated (1) cocoalkylamine, and Ethomeen C/25-ethoxylated (15) cocoalkylamine. The cocoalkyl group can be replaced with tallowalkyl, soyaalkyl or octadecyl groups.

Propoxylated amines are also available from Akzo Corporation as Propomeen C/12 and Propomeen T/12 which respectively are N-cocoalkyl-1,1'-iminobis-2-propanol and N-tallowalkyl-1,1'-iminobis-2-propanol.

Generally the combination of components (A) and (B) are mixed together to form a concentrate or the (A) and (B) components are mixed with water to form the metal working composition. When an (A) and (B) concentrate is formed, the ratio of (A) to (B) generally is from 30–45 to 55–70, preferably from 35–45 to 55–65 and most preferably from 40–45 to 55–60.

The metal working compositions of the present invention comprise a major amount of water and a minor amount of an additive comprising (A) and (B). The term "major amount" includes an amount equal to or greater than 50% by weight such as 50.5%, 70%, 99%, etc. The term "minor amount" includes an amount less than 50% by weight such as 1%, 5%, 20%, 30%, and up to 49.9%. In one embodiment, the metal working compositions of the present invention generally comprise from 85 to 99% water and from 1 to 15% of a combination of components (A) and (B) as per the above concentrate ratios, preferably from 90 to 99% water and from 1 to 10% of a combination of (A) and (B) and most preferably from 95 to 99% water and from 1 to 5% of a combination of (A) and (B).

The below Table I outlines examples of the invention wherein components (A) and (B) are blended with water according to the above ranges to effect solutions. All parts are by weight. Table I additionally reports the tapping torque efficiency as obtained in the Falex Test, ASTM D 5619. This test measures the torque required to tap a thread in a blank specimen nut while lubricated with the metal working fluid of this invention and compared to the torque required to tap a thread in a blank specimen nut while lubricated with a reference fluid. The ratio of the average torque values of the reference fluid to the average torque values of the fluid of the instant invention, when using the same tap, is expressed as the percent efficiency of the fluid.

TABLE I

Tapping Torque Efficiency

| Example | Component (A) | Component B | Water | % Efficiency |
|---|---|---|---|---|
| 1 | 1 part product of Example (A)-3<br>1 part product of Example (A)-4 | 1 part product of Example (B1)-6<br>1 part TEA* | 95.5 parts | 102.3 |
| 2 | 1 part product of Example (A)-4 | 0.5 parts product of Example (B1)-6<br>0.75 parts TEA | 97.75 | 110.3 |
| 3 | 0.5 parts product of Example (A)-3<br>0.5 parts product of Example (A)-4 | 0.5 parts product of Example (B1)-6<br>0.75 parts TEA | 97.75 | 106.5 |
| 4 | 2 parts product of Example (A)-4 | 1 part product of Example (B1)-6<br>1.5 parts TEA | 95.5 | 102.4 |

*triethanolamine

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A metal working composition comprising from 85 to 99% of water and from 1 to 15% of an additive comprising (A) at least one carboxylic ester characterized by the formula

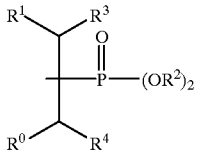

wherein $R^0$ is hydrogen, methyl, ethyl, —$CH_2COOR^2$ or —$CH_2CO(OCHR^5CH_2)_nOR^6$, $R^1$ is hydrogen, methyl or ethyl, $R^2$ is an alkyl group containing from 1 to 12 carbon atoms, $R^3$ is hydrogen or —$CO(OCHR^5CH_2)_nOR^6$, $R^5$ is hydrogen or a methyl group, $R^6$ is an aliphatic group containing from 4 to 30 carbon atoms or a phenyl or aliphatic substituted phenyl group wherein the aliphatic substituent contains from 1 to 8 carbon atoms, $R^4$ is —$COOR^2$, or —$CO(OCHR^5CH_2)_nOR^6$ and n is an integer of from 1 to 30; with the proviso that when $R^0$ does not equal hydrogen, methyl or ethyl that $R^1$ and $R^3$ are hydrogen and (B) at least one rust inhibitor comprising (1) an amine acid salt or amide derived from (a) at least one acid comprising a carboxylic acid corresponding to the formula $$R^7(COOH)_{1-3}$$

wherein $R^7$ is an alkyl, alkylene, alkenylene, alkynylene, hydroxyl alkyl or hydroxyl alkylene group containing from 4 to 25 carbon atoms, and optionally (b) boric acid, with (c) at least one monoamine corresponding to the formula $$(R^8)_3N$$

wherein each $R^8$ is independently hydrogen, a $C_{1-21}$ hydrocarbyl or a $C_{2-21}$ hydroxyl hydrocarbyl group;

(2) a nitrogen-containing, phosphorus-free carboxylic composition made by the reaction of (a) at least one polycarboxylic acid acylating agent having at least one hydrocarbon based substituent of 12 to 500 carbon atoms with (b) at least one (i) N-(hydroxyl-substituted hydrocarbyl) amine, (ii) hydroxyl-substituted poly (hydrocarbyloxy) analog of said amine or (iii) mixtures of (i) and (ii);

(3) an amine of the formula

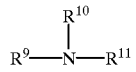

wherein each of $R^9$, $R^{10}$ and $R^{11}$ is individually selected from the group consisting of hydrogen atoms, hydrocarbyl radicals containing from 1 to 40 carbon atoms and hydroxy-substituted hydrocarbyl radicals containing from 1 to 40 carbon atoms provided that at least one of $R^9$, $R^{10}$ and $R^{11}$ is said hydrocarbyl or hydroxy-substituted hydrocarbyl radical; or (4) an alkoxylated amine of the formula

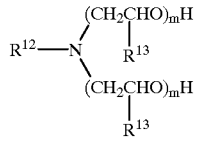

wherein $R^{12}$ is an aliphatic group containing from 8 to 28 carbon atoms, $R^{13}$ is independently hydrogen or methyl and m is an integer independently from 1 to 10.

2. The composition of claim 1 wherein the ester (A) is formed by the reaction of an intermediate and a phosphite wherein the intermediate comprises

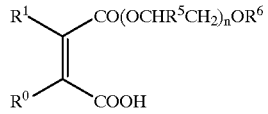

,

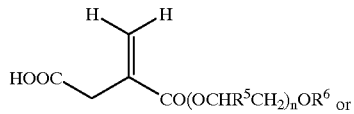

or

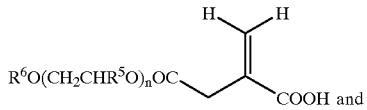

the phosphite is $(R^2O)_3P$ or the intermediate comprises

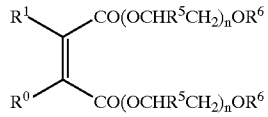

,

-continued

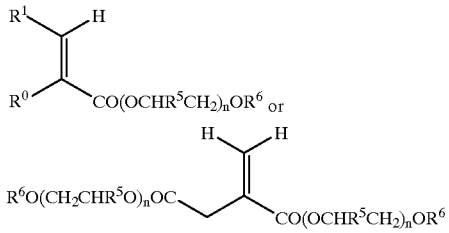

and the phosphite is

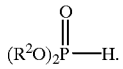

.

3. The composition of claim 2 wherein the intermediate is formed by the reaction of an alkoxylated alcohol or phenol and an acid source; wherein the alkoxylated alcohol or phenol is

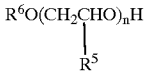

and the acid source comprises a monocarboxylic acid, dicarboxylic acid or anhydride; wherein the monocarboxylic acid comprises acrylic acid, methacrylic acid, cis-2-butenoic acid, trans-2-butenoic acid, or cinnamic acid; the anhydride or dicarboxylic acid comprises

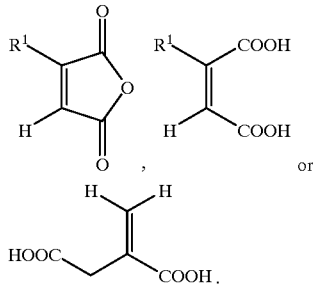

.

4. The composition of claim 3 wherein $R^1$ is hydrogen.

5. The composition of claim 3 wherein the acid source is an anhydride.

6. The composition of claim 3 wherein $R^6$ is an aliphatic group containing from 8 to 18 carbon atoms.

7. The composition of claim 3 wherein $R^5$ is hydrogen.

8. The composition of claim 3 wherein n is from 5 to 21.

9. The composition of claim 2 wherein $R^2$ contains from 1 to 8 carbon atoms.

10. The composition of claim 2 wherein $R^2$ is an ethyl or butyl group.

11. The composition of claim 1 wherein the carboxylic acid (B1a) is a dicarboxylic acid, $R^7$ is an alkylene group containing from about 4 to 15 carbon atoms and boric acid (B1b) is present.

12. The composition of claim 11 wherein within the monoamine (B1c) at least one of $R^8$ is a hydroxyl hydrocarbyl group wherein the hydrocarbyl group is an alkyl group.

13. The composition of claim 12 wherein the carboxylic acid (B1a) is a dicarboxylic acid and $R^7$ contains from 4 to 10 carbon atoms.

14. The composition of claim 13 wherein the dicarboxylic acid (B1a) is sebacic acid, azelaic acid, dodecanedioic acid or mixtures of two or more of said acids.

15. The composition of claim 14 wherein the amine (B1c) is ethanolamine, diethanolamine, triethanolamine, propanolamine, dipropanolamine, tripropanolamine, N,N-di-(lower alkyl) ethanol- or propanolamine or mixtures of two or more said amines.

16. The composition of claim 15 wherein the dicarboxylic acid (B1a) is dodecanedioic acid and the amine (B1c) is ethanol amine.

17. The composition of claim 11 wherein the dicarboxylic acid (B1a) comprises a mixture of dodecanedioic acid, sebacic acid, and azelaic acid and the amine is ethanolamine.

18. The composition of claim 11 wherein (B1) is made from a mixture comprising, on a weight basis, about 15–30% of the dicarboxylic acid (B1a), about 5–21% of boric acid (B1b) and about 40–55% of the monoamine (B1c).

19. The composition of claim 11 wherein (B1) comprises a mixture of an amine salt of a dicarboxylic acid (B1a) and an amine salt of boric acid (B1b).

20. The composition of claim 11 wherein (B1) comprises a mixture of an amide of a dicarboxylic acid (B1a) and an amide of boric acid (B1b).

21. The composition of claim 1 wherein the carboxylic acid (B1a) is a mixture of mono- and dicarboxylic acids wherein $R^7$ is an alkyl or alkylene group containing from 4 to 21 carbon atoms for a monocarboxylic acid and R7 is an alkylene group containing from 4 to 15 carbon atoms for a dicarboxylic acid and boric acid is not present.

22. The composition of claim 21 wherein within the monoamine (B1c) at least one of $R^8$ is a hydroxyl hydrocarbyl group wherein the hydrocarbyl group is an alkyl group.

23. The composition of claim 21 wherein $R^7$ of the monocarboxylic acid contains from 8 to 18 carbon atoms and $R^7$ of the dicarboxylic acid contains from 4 to 10 carbon atoms.

24. The composition of claim 22 wherein the monocarboxylic acid (B1a) is stearic acid, oleic acid, an isomer of octanoic acid, nonanoic acid or decanoic acid or mixtures of two or more of said monocarboxylic acids.

25. The composition of claim 21 wherein the amine (B1c) is ethanolamine, diethanolamine, triethanolamine, propanolamine, dipropanolamine, tripropanolamine, N,N-di-(lower alkyl) ethanol- or propanolamine or mixtures of two or more said amines.

26. The composition of claim 21 wherein the monocarboxylic acid (B1a) comprises at least one isomer of nonanoic acid, an isomer of decanoic acid, and a tall oil fatty acid, the dicarboxylic acid (B1a) comprises at least one of sebacic acid, dodecanedioic acid, and azelaic acid, and the amine (B1c) comprises at least one of ethanolamine, diethanolamine, triethanolamine, aminoethylethanolamine and aminomethylpropanol.

27. The composition of claim 21 wherein (B1) is made from a mixture comprising, on a weight basis, about 21–60% of the carboxylic acid (B1a) and about 40–80% of the monoamine (B1c).

28. The composition of claim 21 wherein (B1) comprises a mixture of an amine salt of a monocarboxylic acid and an amine salt of a dicarboxylic acid.

29. The composition of claim 21 wherein (B1) comprises a mixture of an amide of a monocarboxylic acid and an amide of a dicarboxylic acid.

30. The composition of claim 1 wherein the polycarboxylic acid acylating agent (B2a) is of the formula

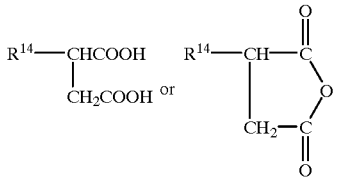

wherein $R^{14}$ is an alkyl or alkenyl group containing from 12 to 500 carbon atoms.

31. The composition of claim 30 wherein $R^{14}$ is poly (isobutene) of 12 to 500 carbon atoms.

32. The composition of claim 1 where the amine (B2b) has from 1 to 4 hydroxyl groups per molecule bonded to a hydrocarbyl group, said hydrocarbyl group being bonded to the amine portion of the molecule.

33. The composition of claim 1 where the amine (B2b) contains up to 40 carbon atoms.

34. The composition of claim 1 wherein the amine (B2b) is a primary, secondary or tertiary alkanol amine of up to 40 carbon atoms.

35. The composition of claim 1 wherein the amine (B2b) is a mixture of at least two alkanol amines of up to 40 carbon atoms.

36. The composition of claim 1 wherein the amine (B2b) is a hydroxy-substituted primary amine of the formula $$R^{15}—NH_2$$

wherein $R^{15}$ is a monovalent organic radical containing at least one hydroxy group, the total number of carbon atoms in $R^{15}$ not exceeding 20.

37. The composition of claim 36 wherein the total number of carbon atoms is $R^{15}$ does not exceed 10.

38. The composition of claim 36 wherein $R^{15}$ contains up to 4 hydroxyl groups.

39. The composition of claim 36 wherein $R^{15}$ is a monohydroxy-substituted alkyl group.

40. The composition of claim 1 wherein the amine (B2b) is a primary, secondary and tertiary alkanol amine which can be represented correspondingly by the formulae:

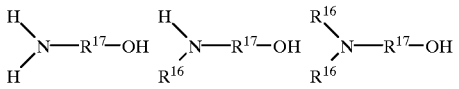

wherein each $R^{16}$ is independently a hydrocarbyl group of one to 8 carbon atoms or hydroxyl-substituted hydrocarbyl group of 2 to about 8 carbon atoms and $R^{17}$ is a divalent hydrocarbyl group of 2 to 18 carbon atoms.

41. The composition of claim 1 wherein the amine (B2b) is a mixture of diethylethanolamine and ethanolamine.

42. The composition of claim 1 wherein there is also present in the composition forming reaction mixture at least one lower molecular weight substituted succinic acid or anhydride in addition to (B2b), said lower molecular weight succinic acid or anhydride represented by the formulae:

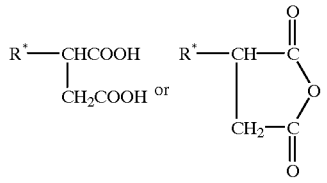

where R* is a hydrocarbyl group containing from 1 to 10 carbon atoms.

43. The composition of claim 1 wherein within the amine (B3) $R^9$ is an aliphatic group containing up to 20 carbon atoms and $R^{10}$ is hydrogen or al aliphatic group containing up to 20 carbon atoms.

44. The composition of claim 1 wherein within the amine (B3) $R^9$ is phenyl, alkylated phenyl, naphthyl, or alkylated naphthyl wherein the alkyl group containing up to 10 carbon atoms and $R^{10}$ is hydrogen or phenyl, alkylated phenyl, naphthyl, or alkylated naphthyl wherein the alkyl group containing up to 10 carbon atoms.

45. The composition of claim 1 wherein within the amine (B3) $R^9$ is a hydroxy-substituted alkyl group wherein the alkyl group contains up to 12 carbon atoms and $R^{10}$ is hydrogen, alkyl or a hydroxy-substituted alkyl group wherein the alkyl group contains up to 12 carbon atoms.

46. The composition of claim 1 wherein within the amine (B3) $R^9$ is a hydroxy-substituted phenyl, alkyl phenyl, naphthyl or alkyl naphthyl wherein the alkyl group contains up to 10 carbon atoms and $R^{10}$ is hydrogen, a hydroxy-substituted phenyl, alkyl phenyl, naphthyl or alkyl naphthyl wherein the alkyl group contains up to 10 carbon atoms.

47. The composition of claim 1 wherein within the alkoxylated amine (B4) $R^{12}$ is an alkyl group containing from 8 to 28 carbon atoms and $R^{13}$ is hydrogen.

* * * * *